United States Patent [19]

Murray et al.

[11] 4,171,050

[45] Oct. 16, 1979

[54] PACKAGING STRUCTURE

[75] Inventors: Lowell C. Murray; Michael L. Weisheit, both of Fort Wayne, Ind.; Louis C. Michetti, Santa Clara, Calif.

[73] Assignee: Container Corporation of America, Chicago, Ill.

[21] Appl. No.: 901,684

[22] Filed: May 1, 1978

[51] Int. Cl.[2] ..... B65D 73/00

[52] U.S. Cl. ..... 206/463; 206/333; 206/446; 206/471; 206/476; 206/485

[58] Field of Search ..... 206/333, 362.4, 485, 206/475, 45.26, 446, 462, 463, 471, 476, 491, 806, 303

[56] References Cited

U.S. PATENT DOCUMENTS

| | | | |
|---|---|---|---|
| 1,569,679 | 1/1926 | Sanborn | 206/485 |
| 1,910,168 | 5/1933 | Jacobs | 206/446 |
| 2,845,758 | 8/1958 | Lowthian | 206/446 |
| 3,912,079 | 10/1975 | Selchow, Jr. | 206/463 |
| 4,046,251 | 9/1977 | Bruml | 206/485 |
| 4,053,050 | 10/1977 | Forbes, Jr. et al. | 206/476 |

FOREIGN PATENT DOCUMENTS

| | | | |
|---|---|---|---|
| 1021499 | 3/1966 | United Kingdom | 206/463 |

*Primary Examiner*—Joseph Man-Fu Moy
*Attorney, Agent, or Firm*—Carpenter & Ostis

[57] ABSTRACT

A package is formed from paperboard for displaying an elongate generally cylindrical article such as a flashlight or the like. The package presents a trough-like structure which cradles the article. Abutment means formed in the package prevent movement of the article. A holding member retains the article against the package.

1 Claim, 7 Drawing Figures

PACKAGING STRUCTURE

FIELD OF THE INVENTION

The invention relates generally to display packages, and is primarily adapted for packaging and displaying of an elongate article such as a flashlight or dry cell battery therefor.

SUMMARY OF THE INVENTION

The structure of the present invention may be used as a display card and is characterized by panel portions folded at an angle less than 90 degrees with respect to the plane of the panel, there being an aperture in each panel. A holding member is formed from the material of one of the panels to retain the article.

THE DRAWINGS

Figure 1:
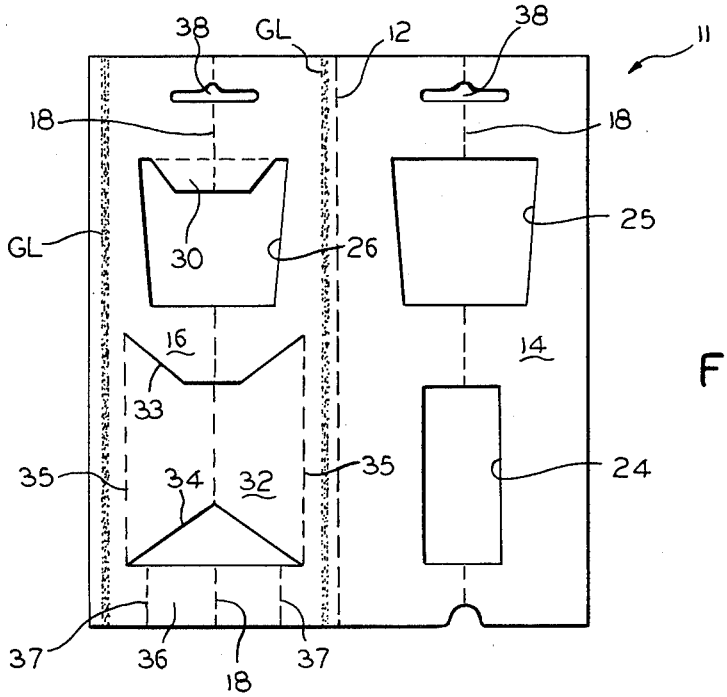
FIG. 1 is a plan view of a cut and scored blank for forming a structure according to the present invention.
Figure 2:
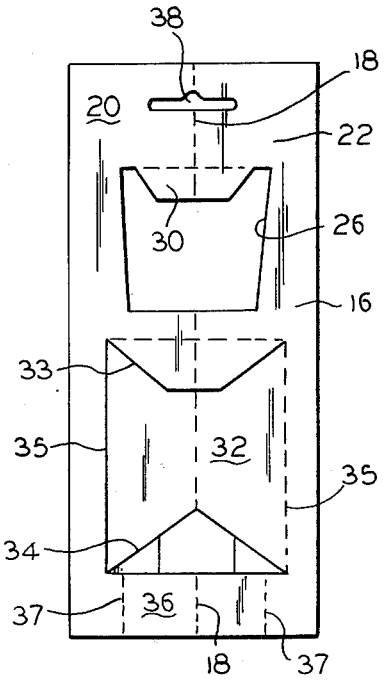
FIG. 2 is an elevational view of the blank of FIG. 1 folded medially upon itself.

The packaging structure according to one embodiment of the invention is denoted generally by the reference numeral 10 and comprises a generally rectangular blank having a line of fold 12 extending transversely thereof to define panels 14 and 16 folded along said line of fold into a face-to-face relationship and secured by glue lines GL.

Figure 3:
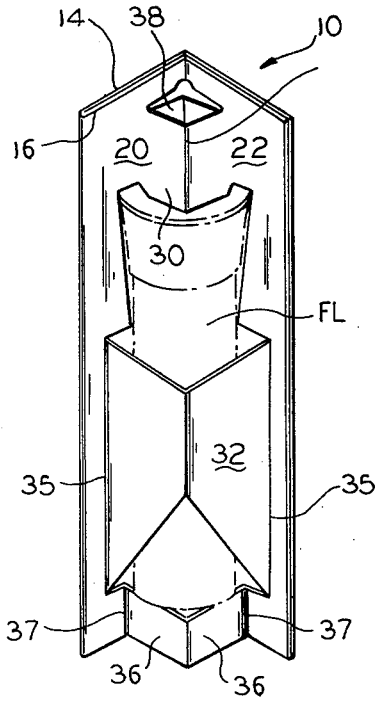
FIG. 3 is an isometric view showing the folded blank of FIG. 2 erected with panel portions in confronting relationship to hold an article.
Figure 4:
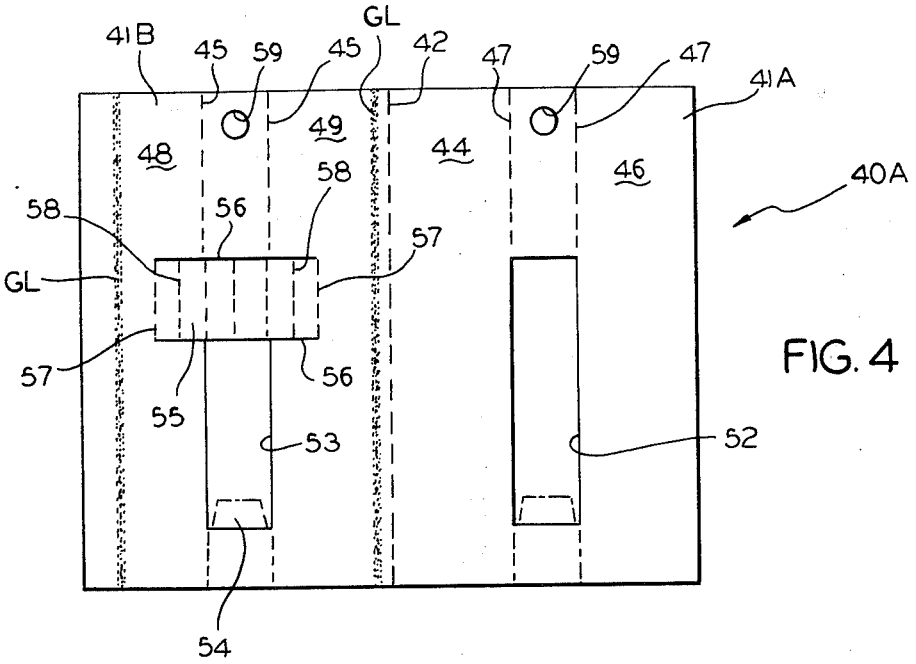
FIG. 4 is a plan view of a cut and scored blank for forming a structure according to another emobdiment of the present invention.
Figure 7:
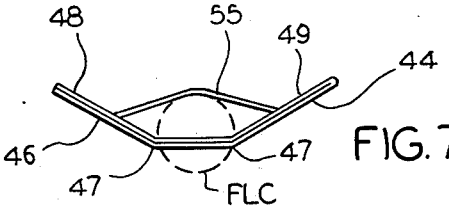
FIG. 7 is a view looking in the direction of the arrows 7—7 of FIG. 6.
Figure 5:
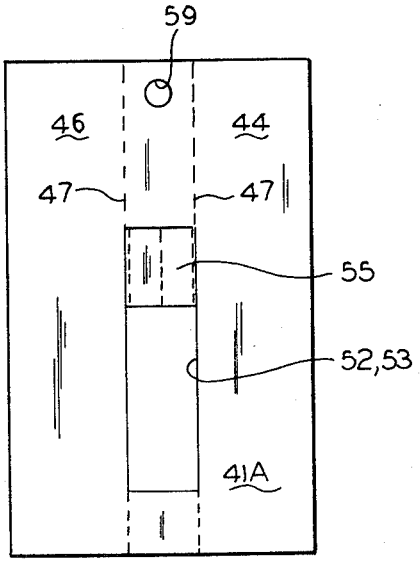
FIG. 5 is an elevational view of the blank of FIG. 4 folded medially upon itself.
Figure 6:
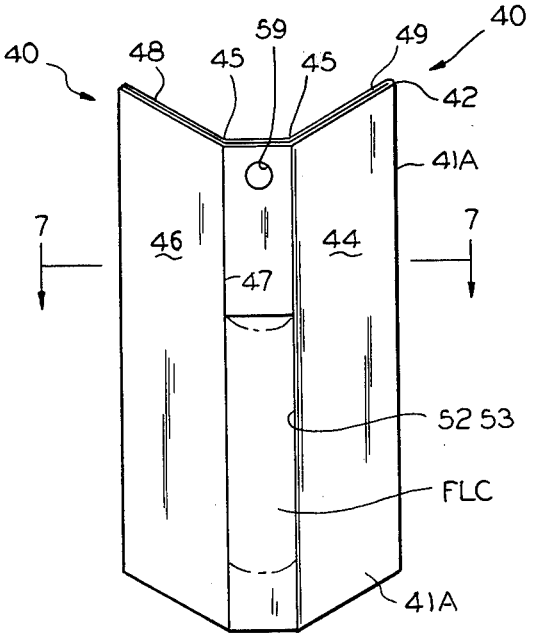
FIG. 6 is an isometric view of the erected structure.

The secured panels 14 and 16 are folded along the fold line 18 to form panel side portions 20 and 22 which are positioned at an angle of less than 90 degrees with respect to the normal plane of the panels to form a trough-like structure therebetween for cradling an article FL shown in FIG. 3.

The panel 14 has an opening 24. An additional opening 25 receives an enlarged portion of the flashlight FL, such as the reflector and bulb assembly. The opening 25 is in an alignment with a similar opening 26 in the panel 16, there being a tab 30 formed in the panel 16 to engage the end of the flashlight assembly, as seen in FIG. 3. The opening 25 has a larger dimension transversely thereof than the opening 24.

An article holder member 32 is provided in the panel portions 20 and 22 and is defined by spaced cut lines 33 and 34 extending transversely of the fold line 18 between the panel portions 20 and 22. The holding member 32 is also defined by fold lines 35 in the respective panel portions 20 and 22.

A support for the lower end of the flashlight FL is provided by an abutment member 36 at the lower end of the panel portions 20 and 22 and foldable out of the planes thereof, it being defined by score lines 37 and by a portion of the fold line 18.

The flashlight FL is supported by the member 36 and retained in position by the tab 30 disposed at its upper end. The holding member 32 is formed about the flashlight FL to hold same in position and against the panel 16.

The upper ends of the panels 14 and 16 have aligned apertures 38 enabling the structure to be suspended from a display rack if desired. It will be noted that the structure may be suspended or caused to stand in position.

Referring now to FIGS. 4 to 7 of the drawings, there is shown another embodiment of the invention referred to generally by the reference numeral 40 and comprising generally rectangular blank 40A having a score line 42 extending transversely thereof to provide two panels 41A and 41B secured in overlying relationship along a glue line GL. The panel 41A has spaced fold lines 47 therein to provide panel side portions 44 and 46 while the panel 41B has a pair of spaced fold lines 45 to provide panel side portions 48 and 49.

The blank 40A which has been folded along the line 42 is then folded along the fold lines 45 and 47 so that the panel portions 48 and 49 are angularly disposed and form an angle of less than 90 degrees with the normal plane of the panels.

The panel 41A has an opening 52 between the lines of fold 47. The panel 41B has an opening 53 defined in part by the fold lines 45 and positioned in register with the opening 52 in the panel 41A. A tab 54 is disposed at the lower end of the opening 53 and struck therefrom to support an article, such as a flashlight cell FLC seen in FIGS. 6 and 7. An article holding member 55 is defined by cut lines 56 extending transversely of the fold lines 45. The holding member 55 is foldably joined to the panel portions 48 and 49 at fold lines 57. Additional score lines 58 in the holding member 55 enable the same to conform to the configuration of the cell FLC and to hold same in the aligned openings 52 and 53.

The two panels 41A and 42B may be provided with aligned openings 59 at one end thereof whereby the completed structure may be suspended at a display rack.

We claim:

1. A package for displaying an article, said package being formed from a blank of paperboard or the like and comprising:

(a) front and rear generally rectangular co-extensive panels disposed in contacting overlying relationship and having opposed marginal portions secured to each other;

(b) a pair of aligned openings in said panels for receiving a portion of said article;

(c) said panels presenting abutment means for engaging opposite ends of said article to prevent axial movement of said article relative to said panels;

(d) said panels each having side portions folded upwardly from the normal plane of said panels at an angle of less than 90 degrees to provide a trough-like structure therebetween for cradling said article;

(e) an article holding member formed from material of said front panel and defined by a pair of spaced cut lines extending generally transversely of said panel;

(f) said article holding member being spaced from the remainder of said front panel and extending over said article to retain said portion of said article in said openings;

(g) a transverse strut formed in said rear panel and positioned in the plane thereof;

(h) said strut bridging said pair of openings in said rear panel to prevent dislodgement of the article through said rear panel.

* * * * *